United States Patent [19]

Head et al.

[11] Patent Number: 4,875,662

[45] Date of Patent: Oct. 24, 1989

[54] METHOD AND APPARATUS FOR RELINING BLAST FURNACE

[75] Inventors: James D. Head; Edward F. Burns; William A. Schleizer, all of Valparaiso; C. Douglas White, Chesterton; Dennis L. Gentry, Cedar Lake, all of Ind.

[73] Assignee: BMI, Inc., Carnegie, Pa.

[21] Appl. No.: 266,371

[22] Filed: Oct. 28, 1988

Related U.S. Application Data

[62] Division of Ser. No. 924,405, Oct. 29, 1986, Pat. No. 4,793,595.

[51] Int. Cl.[4] ..... C21B 13/00; C21B 15/00

[52] U.S. Cl. ..... 266/44; 266/281

[58] Field of Search ..... 266/44, 281

[56] References Cited

U.S. PATENT DOCUMENTS

| | | | |
|---|---|---|---|
| 3,911,175 | 10/1975 | Chemeris | 266/44 |
| 4,253,646 | 3/1981 | Goto | 266/281 |
| 4,313,565 | 2/1982 | Focant | 266/281 |

*Primary Examiner*—Peter D. Rosenberg
*Attorney, Agent, or Firm*—Stanley J. Price, Jr.

[57] ABSTRACT

Method and apparatus to spray the interior surface of a refractory body, such as a blast furnace having circumferentially spaced windows above its mantle, each facing a different wall portion where the interior surface of the shell is most prone to corrode. Two window operations can be employed simultaneously to introduce supply pipes pivotally supported for pivoting about angularly related axes, such as horizontal and vertical axes, and pivoted about at least one of said axes while water is propelled through said elongated pipe to a corroded portion of said interior surface to remove scale from and clean said corroded surface. Air entrained granulated refractory material, preferably mixed with water to form a slurry, is propelled through said pipe to coat the clean interior surface. The two process operation is repeated for each window to clean and reline the entire perimeter of the wall portion if required. Alternatively, all corroded portions may be cleaned in turn followed by relining each cleaned portion in turn.

24 Claims, 1 Drawing Sheet

METHOD AND APPARATUS FOR RELINING BLAST FURNACE

This application is a division of application Ser. No. 924,405, filed Oct. 29, 1986, now U.S. Pat. No. 4,793,595.

BACKGROUND OF THE INVENTION

1. Field of the Invention

This invention relates to method and apparatus for spraying the interior surface of a refractory body such as a blast furance, a metallurgical ladle, soaking pit, a cupola, and the like, that are exposed to elevated temperatures over a long period of use that results in deterioration of the interior refractory surface of the refractory body. This invention also relates to apparatus for spraying said interior refractory surface. It particularly relates to a nozzle assembly supported on the sill of one of a plurality of windows that are circumferentially spaced and that extend through the thickness of a refractory wall at a level above a mantle of said blast furnace. Particularly, the present invention relates to an operation combining two spraying methods, the first spraying method using materials that are sprayed onto an interior surface portion that requires removal of scale. The second spraying method is used to apply a new refractory coating onto the cleaned surface of the wall of the refractory body.

2. Description of the Prior Art

Refractory bodies used in the iron and steel industry for carrying, holding and pouring molten metal are normally exposed to elevated temperature over a long period of use. The interior refractory surfaces of these refractory bodies deteriorate with such extended use. Therefore, it is necessary to either replace or repair any deteriorated interior surface.

Initially, an interior surface was repaired by laying refractory brick over the deteriorated surface. However, the labor cost of brick laying was so exorbitant that the refractory industry has developed high temperature plastic refractories having a pliable construction to permit shaping of the material to the contour of the interior surface being relined. The preshaped plastic refractory material is installed by pneumatic hammers to mold the refractory lining to the contour of the interior surface. It is also known to utilize a heat resistant castable ceramic refractory that is installed on the interior surface in a manner similar to the installation of a conventional castable cement. This requires considerable labor and the erection of frames to contain the castable refractory cement until the latter is cured.

More recently, the deteriorated surface of a blast furnace or the like has been reconditioned and repaired by the gunning application of a refractory material that is formed by mixing a dry mix of refractory binder and aggregate propelled through a hose by a stream of compressed air to a nozzle into which a wetting agent, such as water, is supplied to mix with the dry refractory to form a mix. This mix is sprayed onto the interior surface.

Typical gunning apparatus of the prior art includes Goto et al U.S. Pat. No. 4,253,646; Allison U.S. Pat. No. 4,272,020; Rodway U.S. Pat. No. 4,301,998 and Rymarchyk, Jr. et al U.S. Pat. No. 4,494,737. These patents show a feed pipe for feeding the slurry in a gunning assembly in the direction of the axis of the refractory body whose interior surface is to be sprayed. It is necessary to change the direction of movement of the sprayed slurry so that the path of the movement of the slurry is turned in a direction oblique to the axis of the supply pipe when the slurry reaches its interior end portion through nozzles that extend angularly from the pipe interior end portion to direct the slurry against the interior surface to be sprayed.

Other typical gunning apparatus, such as depicted in Kono et al U.S. Pat. No. 4,106,760; Kubo et al U.S. Pat. No. 4,222,522; and Focant U.S. Pat. No. 4,313,565, pivotally support a slurry supply pipe on a movable car that supports the axis of pivoting of the slurry and must of necessity be a relatively massive counter-weighted car in order to maintain its balance for orientation.

It is also known to form an interior refractory wall within a furnace by establishing a form within the furnace and providing a vibrating hopper above the furnace that feeds particulate refractory materials to the space between the form and the interior wall of the furnace shell and the material deposited in said space is compacted by tamping to form a solid cover of refractory material for the interior furnace wall. A typical device of the latter type is disclosed in Kraus U.S. Pat. No. 4,534,730. A drawback of this material is the tendency of the particulate refractory material to form a dust and the expensive equipment required for avoiding the formation of the dust and the expensive labor cost for removing the form after the refractory wall has been completed.

The methods of applying the material to be sprayed in the form of a liquid or slurry is superior to any method involving compacting a pulverulant material because of the health problems inherent in the formation of dust. However, in the application of liquid or slurry of materials through an elongated pipe, the force by which the liquid or slurry may be imparted is limited when the liquid or slurry is propelled through a delivery pipe-nozzle system that is not straight throughout its entire length. Therefore, it is necessary to provide a higher pressure imparting means to cause the liquid or slurry to be applied at a much higher pressure to overcome the loss of force that occurs when the liquid or slurry is caused to turn at an angle to the initial direction of its propulsion.

It is also beneficial to maintain the temperature of a refractory body within the operating temperature range to minimize the power loss needed for removing unwanted scale and applying a new coating of refractory material that bonds to the cleaned interior surface of a refractory body or blast furnace, particularly when the refractory body is a blast furnace that operates at an extremely high temperature range. The use of concentric pipes in groups within a high temperature atmosphere is detrimental to the continued operation of the spray apparatus that is used to clean or reline an interior surface of such a refractory body in a high temperature environment.

SUMMARY OF THE INVENTION

The present invention provides a method and apparatus for relining a blast furnace or the like. The apparatus involves a plurality of circumferentially spaced windows extending around the periphery of the blast furnace above its mantle. A pedestal is mounted on the sill of each window and a swivel end bracket is pivotally supported about a vertical axis relative to the pedestal. The bracket is provided with a pair of vertical side walls that support horizontal pivot means. An elongated angle iron is constructed and arranged to have its outer end portion pivoted about the horizontal pivot means.

The elongated angle iron supports an elongated pipe so that the elongated pipe has its outer end portion extending outside the window and its inner end extending towards a portion of the interior surface of the blast furnace opposite the window through which the elongated pipe and its supporting elongated angle iron extends. A means is included to provide an air entrained granular refractory material to the outer end of the pipe and independent supply means is connected to a pressurized water supply source to provide water to the elongated pipe. At its inner end, the pipe has an optional pipe extension or reducer of smaller diameter than that of the main portion of the pipe to insure more rapid flow of water when water is propelled through the pipe.

The interior end of the pipe is suspended from a hook at the end of a steel cable that extends over an overhead bracket support to the exterior of the blast furnace around a pulley from a winch. The latter rotates in alternating rotational directions to control the length of steel cable that extends therefrom so it controls the vertical position of the vertically reciprocating inner end of the pipe used to supply either water or slurry to be applied or sprayed against the interior wall of the blast furnace opposite the position occupied by the window through which the supply pipe extends. Means is provided for pivoting the swivel end bracket relative to the pedestal to cause a to and fro movement of the elongated supply pipe, so as to enable the material to be sprayed from the pipe onto a portion of the interior wall that needs spraying. With the arrangement just described, the pipe is caused to pivot simultaneously about two angularly related axes normal to the length of the pipe.

In a particularly effective operation, two spraying methods are applied in sequence. In the first spraying method, water is propelled under pressure sufficient to enable the supply of water to impinge on the interior surface of the blast furnace that has been corroded with scale so as to remove the scale from the portion of the interior surface. During the propulsion of the water, the pipe is swiveled in a horizontal direction while a winch lifts and lowers the inner end of the pipe to enable the water applied under pressure to impinge over a portion of the interior surface of the wall of the blast furnace that has been corroded.

In the second method of the multiple spraying operation, air entrained refractory material of a pulverulant or granular nature is imparted, preferably as a slurry against the interior surface which has been previously cleaned by the first method involving the spraying of water. Other additional abrasive materials should be considered such as pecan shells, corn cobs, rice etc. to further prepare the surface. The operation may be performed at each of the circumferentially spaced windows so that each portion that is first cleaned and then coated by the sequence of methods may be accomplished followed by a sequence of methods at each successive window to enable an entire circumference of the interior surface of said blast furnace to be treated. As an alternative, the water may be applied sequentially through each of the windows to remove scale, and, when the entire circumference has been cleaned, a coating of refractory material formed by spraying a slurry onto the clean interior surface may be applied step-by-step in sequence from each window in succession. It has been determined that four windows, each capable of spraying a quadrant of the circumference of the blast furnace interior surface is preferred, because this arrangement provides sufficient coverage completely around the circumference of the interior surface. In a typical blast furnace, the vertical dimension of the portion needing a new refractory coating by application of the slurry extends from approximately 15 feet below the level of the windows to approximately 15 feet above the level of the windows.

Some of the features of the present invention include supporting the supply pipe on a pedestal mounted at the sill of each window through which the supply pipe extends into the interior of the blast furnace towards the portion of the interior surface which is to be sprayed. Such pedestal support at the furnace opening combines with the support provided by the steel or stainless steel cable depending upon temperatures, whose length is controlled by a winch exterior to the blast furnace and the sliding support of the supply pipe supporting brackets relative to the pedestal on the window sill. Access from outside the furnace to said brackets permits relatively easy maintenance of the bearing surfaces relative to which the movement of the supply pipes is made. In addition, the use of a supply pipe that is straight throughout its length reduces the need for large pressure sources to propel the material sprayed at a given speed, or, in the alternative, assures the propulsion of the material sprayed at a maximum speed possible with the pressurized source available for propelling said spraying materials.

The aforesaid and addition benefits of the present invention will be better understood in the light of the description of a preferred embodiment of this invention that follows.

DESCRIPTION OF THE DRAWINGS

In the drawings that form part of a description of the preferred embodiments of this invention.

DESCRIPTION OF THE PREFERRED EMBODIMENTS

Figure 1:
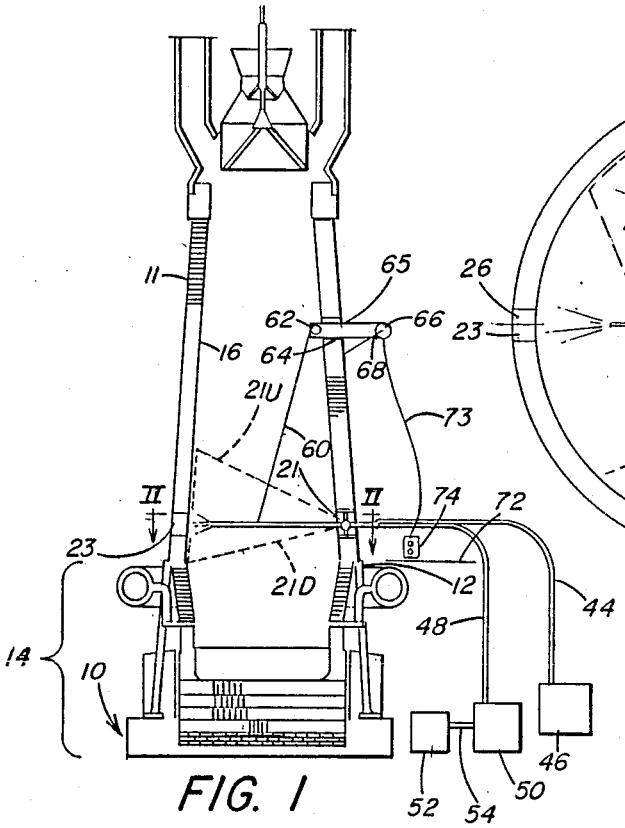
FIG. 1 is a vertical section of a blast furnace modified in accordance to the present invention.
Figure 2:
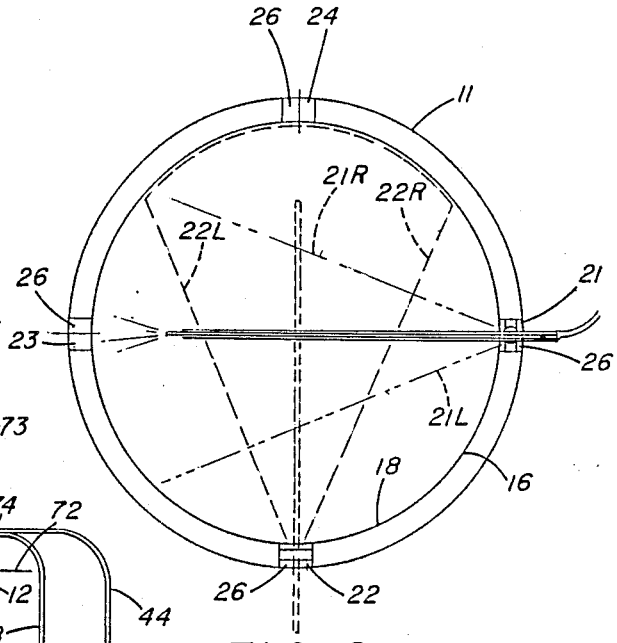
FIG. 2 is a horizontal cross-section taken along the line II—II of FIG. 1.
Figure 3:
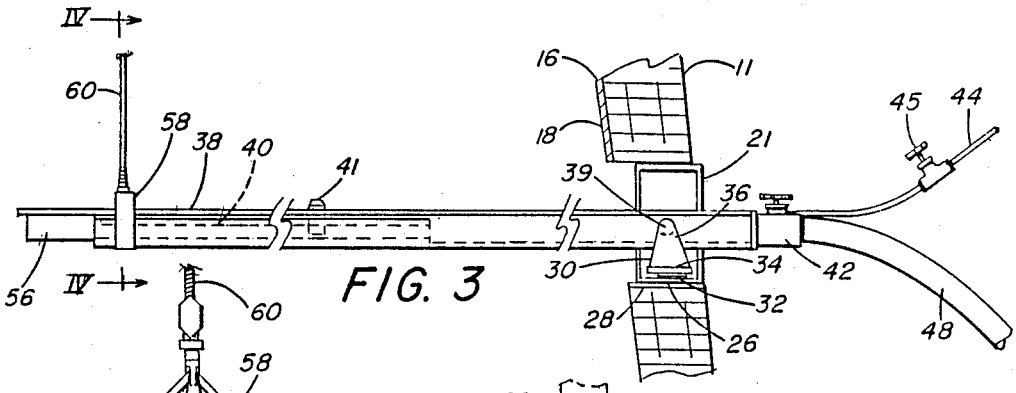
FIG. 3 is an enlarged, fragmentary vertical view of a supply pipe showing its manner of support and attachment to other supply lines.
Figure 4:
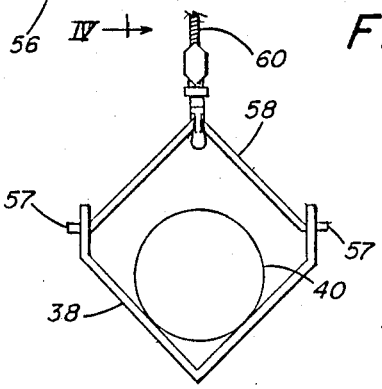
FIG. 4 is a view taken along a line IV—IV of FIG. 3.
Figure 5:
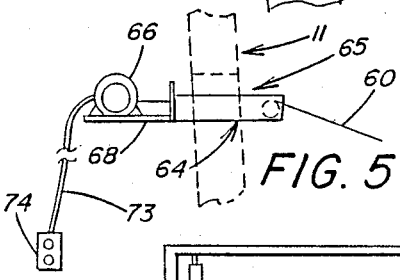
FIG. 5 is a fragmentary view of the cable winch and remote control for the winch.
Figure 6:
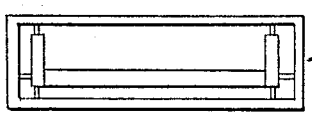
FIG. 6 is a front view of the cable roller.

Referring to the drawings, a blast furnace 10 is shown having a construction that includes a generally truncated conical-shaped furnace wall 11 that extends vertically obliquely upward from a mantle 12 at the base of the wall. The portion of the furnace below mantle 12 comprises a conventional bosh, hearth and other conventional blast furnace elements which are not modified by the present invention and need not be described in this description so as to avoid extending the length of this specification unduly.

Furnace 10 has an inner shell 16 formed of abutting steel plates. The interior surface 18 of the shell is susceptible to corrosion when the furnace is in operation over a long period of time. According to a preferred embodiment of the present invention, circumferentially spaced windows 21, 22, 23, and 24 are provided to extend through the furnace wall 11. The windows have sills 26 located approximately ten (10) feet above the mantle 12. Each sill 26 supports a pedestal 28. A swivel end bracket 30 is pivotally supported on each pedestal 28 by a vertical pivot bearing 32 at approximately the geometric center of the pedestal so as to enable the swivel end brackets to swivel relative to the pedestal about an angle of at least 45 degrees to each side of the diameter of a horizontal circle formed at the horizontal plane across the blast furnace that intersects sill 26.

Each bracket 30 is provided with a pair of vertical side walls 34. Each of the latter is grooved in its upper portion to provide a groove type bearing support 36, the purpose of which will be described soon.

An elongated angle iron 38 having oppositely extending stub rods 39 is inserted through the window 21 and into the furnace until stub rods 39 fit into the groove-type bearing supports 36 of the bracket 30. The elongated angle iron 38 supports an elongated pipe 40 throughout its entire angle iron length. The elongated angle iron 38 is provided with longitudinally spaced rings 41 through which pipe 40 extends to keep the latter aligned therewith.

When installed for operation, the elongated pipe 40 extends from its outer end a short distance outside one of the windows 21 to 24 of blast furnace 10 to its inner end facing interior surface 18 of shell 16 of furnace wall 11 diametrically opposite the window within which the pipe is inserted. A coupling 42 communicates with the outer end of pipe 40. A water supply line 44 valved at 45 supplies water under pressure into the outer end of elongated pipe 40 from a pressurized water supply source 46. In addition, a granular refractory supply line 48 extending from a granular refractory source 50 to coupling 42 is also provided. Furthermore, a pressurized air source 52 communicates with the granular refractory source 50 through an air supply line 54. In addition, water supply line 55 is connected to a granular refractory source 50 for predampening granular refractory material.

The elongated pipe 40 may be supplied with an optional pipe extension or reducer 56 that tapers in interior diameter toward the inner end of pipe 40. In a preferred embodiment of this invention, the elongated pipe 40 is made of aluminum pipe 1½ inches in diameter cradled in an elongated angle iron 38 having flanges 3 inches wide. The pipe extension 56 reduces the diameter of the pipe from the 1½ inch diameter throughout the length of the pipe to approximately ¾ to 1 inch diameter. The purpose of the optional pipe extension or reducer 56 is to enhance the rate of flow of materials supplied through the elongated pipe.

An open-ended polygonal hook 58 suspended from the lower end of a steel cable 60 is supported by a bracket support 62 which in turn is secured to a winch support 64 mounted on the shell 16. The steel cable extends through an opening 65 in the furnace wall 11 approximately 16 feet above the level of sills 26 to a winch 66 supported externally of the furnace 10 by a winch support 68. Remote winch cable 73 extends downward from winch 66 to remote controls 74 which is carried at a support level 72 at which operators may stand to peer through the windows 21 to 24.

Winch 66 operates reversibly to extend and retract steel cable 60 to cause elongated pipe 40 to move vertically with hook 58 between an upper limit 21 U and on a lower limit 21 D. Also, means is provided to reciprocate the bracket 30 relative to the vertical pivot bearing 32 carried on pedestal 28 to pivot the elongated pipe 40 over an angle of at approximately 90 degrees or slightly more to enable the inner end of elongated pipe 40 to scan a quadrant of the interior surface 18, the center of which is defined by a vertical plane passing through the diameter of the horizontal cross-section of the blast furnace at the level of sills 26.

The apparatus just described is used whenever an inspection of a blast furnace shows that a part of the interior wall has become corroded. The portion of the interior wall most likely to be corroded is a band extending circumferentially of the interior surface from a lower level about 5 feet above the mantle 12 to an upper level approximately 20 feet above the mantle. Therefore, the location of the sills 26 at approximately 10 feet above the level of the mantle is most suitable to practice the present invention.

Whenever a portion of the interior surface of a blast furnace becomes corroded and begins to scale, it is necessary to first remove the scale and then apply a new refractory coating to the area that has been cleaned of the scale. The preferred thickness of the refractory material to be applied to the interior surface 18 is preferably in the range between 18 and 22 inches.

In using the apparatus just described, the elongated angle iron 38 with the elongated pipe 40 inserted through the longitudinally spaced rings 41 is surrounded by the polygonal-shaped, open-ended hook 58 that is applied around the inner portion of the angle iron 38. The winch 70 has been rotated in a direction to lower the steel cable 60 with its open ended polygonal hook 58 extending from the bottom thereof. A short hook is used to grab the open-ended polygonal hook 58 to bring the open ended polygonal hook 58 in surrounding relation to the elongated angle iron 38 and its supported elongated pipe 40 is threaded through longitudinally spaced rings 41. The pipe 40 extends beyond the interior end of the elongated angle iron 38 and the exterior end of the elongated pipe 40 extends beyond the end of the elongated angle iron 38. Pedestal 28 is also provided with a pair of rollers (not shown) to facilitate rolling movements of the elongated angle iron 38 from a position exterior of the blast furnace to a position within the furnace. The winch 70 is adjusted to permit the length of the steel cable 60 to be adjusted as the angle iron 38 and its supporting elongated pipe 40 is inserted into the interior of the blast furnace 10 through one of the circumferentially spaced windows 21, 22, 23, or 24.

If the spraying method involves the application of water under high pressure to remove scale as in the first method of a two method operation, it is advisable to attach the optional pipe extension or reducer 56 to the front of the elongated pipe 40 that forms the interior end of the pipe before the pipe and its supporting angle iron 38 are inserted into the blast furnace. The pipe 40 supported on angle iron 38 is inserted through the window 21 into the interior of the refractory body or blast furnace 10 with the interior end of the elongated pipe 40 facing a part of the portion of the interior surface 18 diametrically opposite window 21 and an exterior portion of the pipe extending outside of the refractory body. The elongated angle iron 38 arrives at an axial position such that the stub rods 39 are received in the groove type bearing supports 36 of bracket 30 so as to pivotally support the pipe for pivoting relative to the sill 26 of window 21 in a vertical plane about a horizontal pivot axis defined by stub rods 39. Also, pipe 40 can pivot about a vertical axis defined by vertical pivot 32 in a horizontal direction on both sides of a vertical plane intersecting the diameter of the horizontal cross-section of the blast furnace 10 at the level of sills 26 to a maximum angle of at least 45 degrees to each side of said vertical plane. While the two axes of pivoting are orthogonal to each other and to the length of pipe 40, it is understood that the axes of pivoting may be oblique to one another without departing from the spirit of this invention. The winch 70 is simultaneously controlled to lift and lower the inner end of elongated angle iron 38 and its supported elongated pipe 40 so that the inner end of the elongated pipe 40 faces a portion of the interior wall 18 of the blast furnace 10 that extends between a lower limit elevation that is 15 feet below the sills 26 at its lower end as defined by line 21D in FIG. 1 and an upper limit as defined at a line of intersection on the interior surface 18 intercepted by line 21U which is approximately 15 feet above the horizontal plane of the sills 26.

In the first spraying method performed in a two method operation, water is supplied under pressure through water supply line 44 from pressurized water supply source 46 through coupling 42 communicating with the outer end of pipe 40 and through the entire length of the elongated supply pipe 40 and its optional pipe extension or reducer 56 to enable the water to be propelled at a speed sufficient to impinge on the interior surface 18 with force sufficient to remove the scale from the impinged portion of the interior surface. When the entire area requiring removal of scale has been cleaned, the pipe 40 and its supporting angle iron 38 are removed from the interior of the furnace, through window 21, the optional pipe extension or reducer 56 is dismantled from the front of pipe 40, the elongated angle iron 38 and its supported elongated pipe is again introduced through window 21 into the interior of the blast furnace to assume the position they occupied for the scale removal process to perform a second spraying method of a two method operation that constitutes a preferred embodiment of this invention. A pulverulant can be used to enhance cleaning process.

The coupling 42 receives pressurized water from the pressurized water supply source 46 through the water supply line 44 as well as air entrained granular refractory materials through the granular refractory supply line 48 which supplies the granular refractory from granular refractory source 50. To accelerate the application of the granular refractory materials from source 50, pressurized air from pressurized air source 52 is supplied through supply line 54 into the granular refractory source 50 to help propel the granular refractory materials through the granular refractory supply line 48. The pressurized water mixes with the air entrained granular refractory material at the coupling 42 and is imparted through the length of the supply pipe 40. Simultaneously, the latter is moved in a reciprocating manner with a horizontal component of motion about the vertical pivot point 32 and is also reciprocated vertically about a horizontal axis defined by stub rods 39 through the simultaneous raising and lowering of the hook 58 at the bottom end of steel cable 60 in response to the periodical reversal of the rotation of winch 70 so as to cause the inner end of supply pipe 40 to supply a slurry containing water mixed with the granular refractory material to be applied against the quadrant of interior surface 18 that is opposite window 21. The application of the slurry continues until a coating of a refractory material of desired thickness, preferably 18 to 22 inches thick, is applied onto the clean interior surface 18 from which scale has been removed by the first method.

The operation performing the first method and the second method consecutively can then be performed at window 22 followed by performing the operation at window 23 and then at window 24 until all of the corroded portions of the interior surface 18 have been cleaned of scale and the cleaned surface portions coated with a suitable thickness of refractory material. During this operation, it is not necessary to cool the blast furnace. Therefore, the furnace can continue to burn while the scale is removed and replaced by the refractory slurry applied to the interior surface 18.

As an alternative to the aforesaid process, it is possible to perform the first method at each of the four windows in turn and then, after the entire band 30 feet high of interior surface 18 has been cleaned by removing all scale therefrom, the coating with a refractory slurry can be accomplished from each of the four windows in sequence. In the latter case, it is only necessary to remove the optional pipe extension 56 from the front of the supply pipe 40 after the multiple step cleaning method has been completed and the blast furnace is ready for the application of additional coating of refractory material. However, it is understood that only four steps of removing and replacing the optional pipe extension or reducer 56 is needed if the cleaning method is performed alternately with the method of applying the replacement refractory coating at each individual window.

While the preferred embodiment shows four windows arranged at 90 degree spacing around the perimeter of the wall 11 of the blast furnace 10, with each window providing the source for application of materials to first clean and then recoat a different quadrant for each window, it is understood that fewer or more windows may be provided, depending upon the size and diameter of the blast furnace, without departing from the gist of this invention.

While the described operation for relining a blast furnace involving a first spraying method of applying water to clean the interior surface of the blast furnace followed by a second spraying method of applying a new coating of the refractory materials onto the cleaned surface by applying a slurry of coating material, the principles of this invention are equally applicable to a spraying method to deposit any material suitable for treating an interior surface of a refractory body. Therefore, the present invention is not necessarily limited to the two method operation described, but may be employed in a method of spraying to either clean a corroded interior surface or to apply a coating of refractory material upon the interior surface of a refractory body.

According to the provisions of the patent statutes, the principle, preferred construction and mode of operation of this invention have been explained and what is presently considered to represent its best embodiment has been illustrated and described. However, it should be understood that, within the scope of the claims that follow, this invention may be practiced otherwise than as specifically illustrated and described.

What is claimed is:

1. A method of spraying material upon at least a portion, that requires spraying, of a wall of a refractory body extending upward from a mantle and having a plurality of circumferentially spaced windows extending through said wall at a level above said mantle, each said window being opposite a different portion of said interior surface, said method comprising:

selecting one of said plurality of circumferentially spaced windows, said selected window having a sill, extending an elongated pipe through said selected window into the interior of said refractory body with the interior open end of said elongated pipe facing a part of said portion of said interior surface opposite said selected window and an exterior portion of said pipe extending outside said refractory body, pivotally supporting said pipe relative to said sill of said selected window to allow said pipe to pivot about two angularly related axes normal to the length of said pipe where said pipe intersects said sill of said selected window, supplying material to be sprayed to said exterior portion of said pipe, applying air under pressure to said exterior portion of said pipe to propel said material to be sprayed through said pipe open end in a direction generally perpendicular to a first part of said portion of said interior surface to impinge on a first part of said portion of said interior surface facing said interior open end of said pipe, and pivoting said pipe about at least one of said angularly related axes while continuing said supplying and applying steps to propel said material onto a different part of said portion of said interior surface in a direction generally perpendicular to a first part of said portion of said interior surface and adjacent to said first part until said parts of said portion that require spraying are sprayed.

2. A method as set forth in claim 1, wherein said portion to be sprayed is covered with scale, wherein said sprayed material comprises water supplied and air applied under sufficient pressure to enable said supplied water to impinge on said interior surface with a force sufficient to remove said scale from said portion of said interior surface.

3. A method as set forth in claim 2, wherein said water is supplied and said air is applied through an interior end portion of restricted diameter of said pipe after said water and said air traverse said pipe toward said interior end portion.

4. A method as set forth in claim 1, wherein said refractory body is a blast furnace for making molten iron that usually operates within an elevated temperature range, further including maintaining said blast furnace at said elevated temperature range during the performance of said method.

5. A method as set forth in claim 1, further including:

removing said elongated pipe from said selected window, selecting a second window having a sill, extending said pipe through said selected second window into the interior of said refractory body with the interior end of said elongated pipe facing a part of another portion of said interior surface opposite said selected second window and an exterior portion of said pipe extending outside said refractory body, pivotally supporting said pipe relative to said sill of said selected second window to allow said pipe to pivot about two angularly related axes normal to the length of said pipe where said pipe intersects said sill of said selected second window, supplying material to be sprayed to said exterior portion of said pipe, applying air under pressure to said exterior portion of said pipe to propel said material to be sprayed through said pipe to impinge on a first part of said another portion of said interior surface facing said interior open end of said pipe, and pivoting said pipe about at least one of said angularly related axes while continuing said supplying and applying steps to propel said material onto a different part of said another portion of said interior surface adjacent to said first part until said parts of said additional portion that require spraying are sprayed.

6. A method as set forth in claim 1, wherein said material sprayed contains granular refractory material and air applied under sufficient pressure to entrain air within said granular refractory material and to enable said air entrained refractory material to impinge on said interior surface with a force sufficient to bond said refractory material to said interior surface.

7. A method as set forth in claim 6, further including directing water into said air entrained granular refractory material to form a slurry and propelling said slurry of refractory material toward said interior surface.

8. A method as set forth in claim 1, including pivoting said pipe about both said angularly related axes while continuing said supplying and applying steps until said parts of said portion of said interior surface generally perpendicular to and facing said one of said selected windows that require spraying are sprayed.

9. A method as set forth in claim 8, further including:

removing said pipe from said selected window, selecting a second window having a sill, extending said pipe through said selected second window in the manner recited for said pipe extending step with respect to said selected first window as set forth in claim 8, pivoting said pipe relative to said sill of said selected second window in the manner recited for said pivotally supporting step with respect to said selected first window as set forth in claim 8, and repeating said material supplying, said air applying and said pipe pivoting steps with respect to said selected second window in the manner recited for said corresponding steps with respect to said selected first window as set forth in claim 8 until said parts of said portion of said interior surface facing said selected second window that require spraying are sprayed.

10. A method as set forth in claim 9, further including:

selecting other windows, repeating said pipe removing, pipe extending, pivotally supporting, material supplying, air applying and pipe pivoting steps with respect to said other selected windows until said steps are repeated at all of said windows and all said parts of all said portions facing all said windows that require spraying are sprayed.

11. An operation for relining at least a portion of the interior surface of a wall of a blast furnace extending upward from a mantle and having a plurality of circumferentially spaced windows extending through said wall at a level above said mantle, each said window being opposite a different portion of said interior surface that requires relining, said operation comprising a sequence of spraying methods including:

first performing a method as set forth in claim 1, wherein said sprayed material comprises water supplied and air applied under sufficient pressure to enable said supplied water to impinge on said interior surface with a force sufficient to remove said scale from said interior surface to develop a clean interior surface portion, and then performing a spraying method as set forth in claim 1 on said clean interior surface portion, wherein said sprayed material comprises granular refractory material and air applied under sufficient pressure to entrain air within said granular refractory material and to enable said air entrained refractory material to impinge on said interior surface with a spraying force sufficient to bond said refractory material to said clean interior surface.

12. A method as set forth in claim 11, wherein said method performed on said clean interior surface portion further includes directing water into said air entrained granular refractory material to form a slurry, and propelling said slurry of refractory material toward said interior surface.

13. A method as set forth in claim 11, further including repeating said sequence of spraying methods to spray each additional interior surface portion of said blast furnace or the like that requires relining, each said additional interior surface portion being opposite a different said window, by extending said pipe through each said different window in turn to perform the method as set forth in claim 11 on each additional interior surface portion that requires relining, in turn.

14. A method as set forth in claim 12, further including repeating said sequence of spraying methods to spray each additional interior surface portion of said blast furnace that requires relining, each said additional interior surface portion being opposite a different window, by extending said pipe through each different window in turn to perform the method as set forth in claim 12 on each additional interior surface portion that requires relining.

15. A method as set forth in claim 11, further including repeating said first method of said sequence of spraying methods as set forth in claim 11, to spray each additional interior surface portion of said blast furnace that requires relining, each additional interior surface portion being opposite a different said window, until scale is removed from each said additional interior surface portion to develop additional clean internal surface portions, followed by repeatedly performing said second method of said sequence of spraying methods set forth in claim 11 to spray each interior surface portion opposite each said window in sequence until said refractory material is bonded to each said clean interior surface portions.

16. A method as set forth in claim 12, further including repeating said first method of said sequence of spraying methods as set forth in claim 12 to spray each additional interior surface portion of said blast furnace that requires relining, each additional interior surface portion being opposite a different window, until scale is removed from each said additional interior surface portion to develop additional clean internal surface portions, followed by repeatedly performing said second method of said sequence of spraying methods set forth in claim 12 to spray each interior surface portion opposite each window in sequence until said refractory material is bonded to each of said clean interior surface portions.

17. A method as set forth in claim 11, wherein said blast furnace is operated at an elevated temperature range, further including maintaining said blast furnace at said elevated temperature range while performing said method.

18. A method as set forth in claim 12, wherein said blast furnace is operated at an elevated temperature range, further including maintaining said blast furnace at said elevated temperature range while performing said method.

19. A method as set forth in claim 13, wherein said blast furnace is operated at an elevated temperature range, further including maintaining said blast furnace at said elevated temperature range while performing said method.

20. A method as set forth in claim 14, wherein said blast furnace is operated at an elevated temperature range, further including maintaining said blast furnace at said elevated temperature range while performing said method.

21. A method as set forth in claim 15, wherein said blast furnace is operated at an elevated temperature range, further including maintaining said blast furnace at said elevated temperature range while performing said method.

22. A method as set forth in claim 16, wherein said blast furnace is operated at an elevated temperature range, further including maintaining said blast furnace at said elevated temperature range while performing said method.

23. A method as set forth in claim 1, further including cycling a horizontal component of motion to pivot said pipe in alternate directions about a vertical axis of pivoting that intersects said sill, and simultaneously cycling a vertical component of motion to pivot said pipe in alternate directions about a horizontal axis of pivoting.

24. A method as set forth in claim 23, comprising engaging the interior end portion of said elongated pipe with a hook and raising and lowering said hook in a cyclic motion to cycle said vertical component of motion.

* * * * *